US005195191A

United States Patent [19]

Stefan et al.

[11] Patent Number: 5,195,191

[45] Date of Patent: Mar. 23, 1993

[54] POOL SKIMMER MOUNT

[75] Inventors: Gunter Stefan, Unionville; William Kindness, Etobicoke, both of Canada

[73] Assignee: Kafko International Inc., Mississauga, Canada

[21] Appl. No.: 727,212

[22] Filed: Jul. 9, 1991

[30] Foreign Application Priority Data

Jul. 16, 1990 [CA] Canada ..... 2021267

[51] Int. Cl.[5] ..... E04H 4/14

[52] U.S. Cl. ..... 4/508; 4/496; 4/512

[58] Field of Search ..... 4/506, 507, 508, 509, 4/510, 512, 496; 210/169

[56] References Cited

U.S. PATENT DOCUMENTS

| | | | |
|---|---|---|---|
| 3,701,427 | 10/1972 | Howard . | |
| 3,841,487 | 10/1974 | Villette | 210/169 X |
| 4,426,286 | 1/1984 | Puckett et al. | 210/169 X |
| 4,454,035 | 6/1984 | Stefan . | |
| 4,561,134 | 12/1985 | Mathews et al. | 4/496 |
| 4,735,714 | 8/1988 | Schall | 210/169 |
| 4,913,810 | 4/1990 | Hodak | 210/169 |
| 5,040,251 | 8/1991 | Hanford | 4/496 |

FOREIGN PATENT DOCUMENTS 1169330 6/1984 Canada .

*Primary Examiner*—William A. Cuchlinksi, Jr.
*Assistant Examiner*—W. Morris Worth
*Attorney, Agent, or Firm*—Moss, Barrigar & Oyen

[57] ABSTRACT

A multi-gasket sealing assembly or mount is disclosed for improved mounting of a swimming pool water skimmer in an opening in a pool wall of the type having a metal wall portion and a flexible inner sheet liner. The water skimmer has a housing defining a water inlet chamber for intake of water and an annular chamber end portion which protrudes through the pool wall opening. The housing also has an outwardly projecting peripheral flange spaced from the chamber end portion, the flange being bolted to the metal wall portion. A continuous gasket is located around the chamber end portion. An annular face plate is connected to the chamber end portion to compress the gasket and also to press the pool liner against the metal wall portion to prevent water from getting behind the liner. Another gasket is compressed between the peripheral flange and the metal wall portion to seal against the ingress of sand and other particulate matter into the skimmer from behind the pool wall. The mount prevents swimming pool water from contacting exposed metal of the pool wall.

15 Claims, 5 Drawing Sheets

POOL SKIMMER MOUNT

FIELD OF THE INVENTION

The present invention relates generally to the field of watertight wall mounts and more particularly to an improved method of mounting a swimming pool skimmer into a pool wall of the type having a metal wall portion and a flexible inner sheet liner.

BACKGROUND OF THE INVENTION..

Swimming pool water skimmers are an important component in maintaining water quality and cleanliness in swimming pools, providing continual service in removing floating debris from the surface of the water. Water skimmer units are typically embedded below the pool deck level at the pool perimeter and communicate with the surface water in the pool through a pool wall orifice with a water inlet chamber half submerged. Surface water enters the skimmer via the inlet chamber and then flows to a filter unit wherein it is filtered and subsequently returned to the pool. The skimmer, in addition to its filtering function, is typically used to introduce into the pool various chemicals used for maintaining water purity, some examples of which are sodium hypochlorite, chlorine and calcium hypochlorite just to mention a few. Being mechanical devices and needing periodic repair and replacement, it is desirable to mount the water skimmer unit in a fashion which permits the unit to be readily demounted.

The normal method of mounting the water skimmer unit to the swimming pool wall of the type in question is to cut a hole in the steel wall portion and flexible liner and bolt the skimmer inlet housing to a steel swimming pool wall around the periphery of the opening. An inner face plate and gasket is then attached with screws around the perimeter of the pool wall orifice on the pool wall interior. A significant drawback to this type of arrangement has been the fact that it affords little protection to the exposed bare metal around the orifice inner perimeter. The resulting water corrosion of the exposed metal surfaces produces corrosion products which deposit on and react with the plastic interior of the skimmer inlet chamber resulting in unsightly discoloration of the latter. The presence of the above mentioned water purification chemicals will tend to accelerate the corrosion and general degradation of any exposed metal, not to mention the presence of various highly corrosive acids such as sulphuric and nitric acid which are major components in acid rain, and hence must be considered when designing outdoor swimming pools. Accordingly, there is a need to provide an improved water skimmer mount which effectively protects any exposed metal from the corrosive aqueous environment.

SUMMARY OF THE INVENTION

In the present invention, a skimmer housing has an outwardly projecting peripheral flange for attachment to the pool metal wall portion, and a portion of the housing projects through the pool wall. A face plate and associated gasket prevents pool water from getting behind the liner to contact the metal wall portion.

According to one aspect of the invention, there is provided a pool skimmer mount adapted to be mounted in a swimming pool wall having a metal outer wall portion and a flexible inner sheet liner. The mount comprises a housing which is adapted to be located at an opening end in the pool wall. The housing has means defining an inlet chamber communicating with pool surface water through the opening. The housing has a forwardly disposed chamber end portion adapted to project through the pool wall opening. The housing also has an outwardly projecting peripheral flange spaced from the chamber end portion. The peripheral flange is adapted to be coupled to the metal pool wall portion. A gasket is located on the chamber end portion. An annular face plate is adapted to be secured to the chamber end portion, the face plate having an outer flange adapted to compress the pool liner against the gasket.

According to another aspect of the invention, there is provided a pool skimmer mount for attaching a pool skimmer to a swimming pool wall having a metal outer wall portion and a flexible inner sheet liner. The mount comprises a housing located in an opening in the pool wall. The housing has an inlet chamber communicating with pool surface water through the opening. The housing has a forwardly disposed chamber end portion projecting through the wall opening and an outwardly projecting peripheral flange spaced from the chamber end portion. Means are provided for connecting the peripheral flange to the metal pool wall portion. A continuous gasket is mounted on the chamber end portion. Also, an annular face plate is connected to the chamber end portion, the face plate having an outer flange compressing the pool liner against the gasket.

BRIEF DESCRIPTION OF THE DRAWINGS.

Preferred embodiments of the invention will now be described by way of example with reference to the accompanying drawings, in which.

DETAILED DESCRIPTION OF THE PREFERRED EMBODIMENTS

Figure 1:
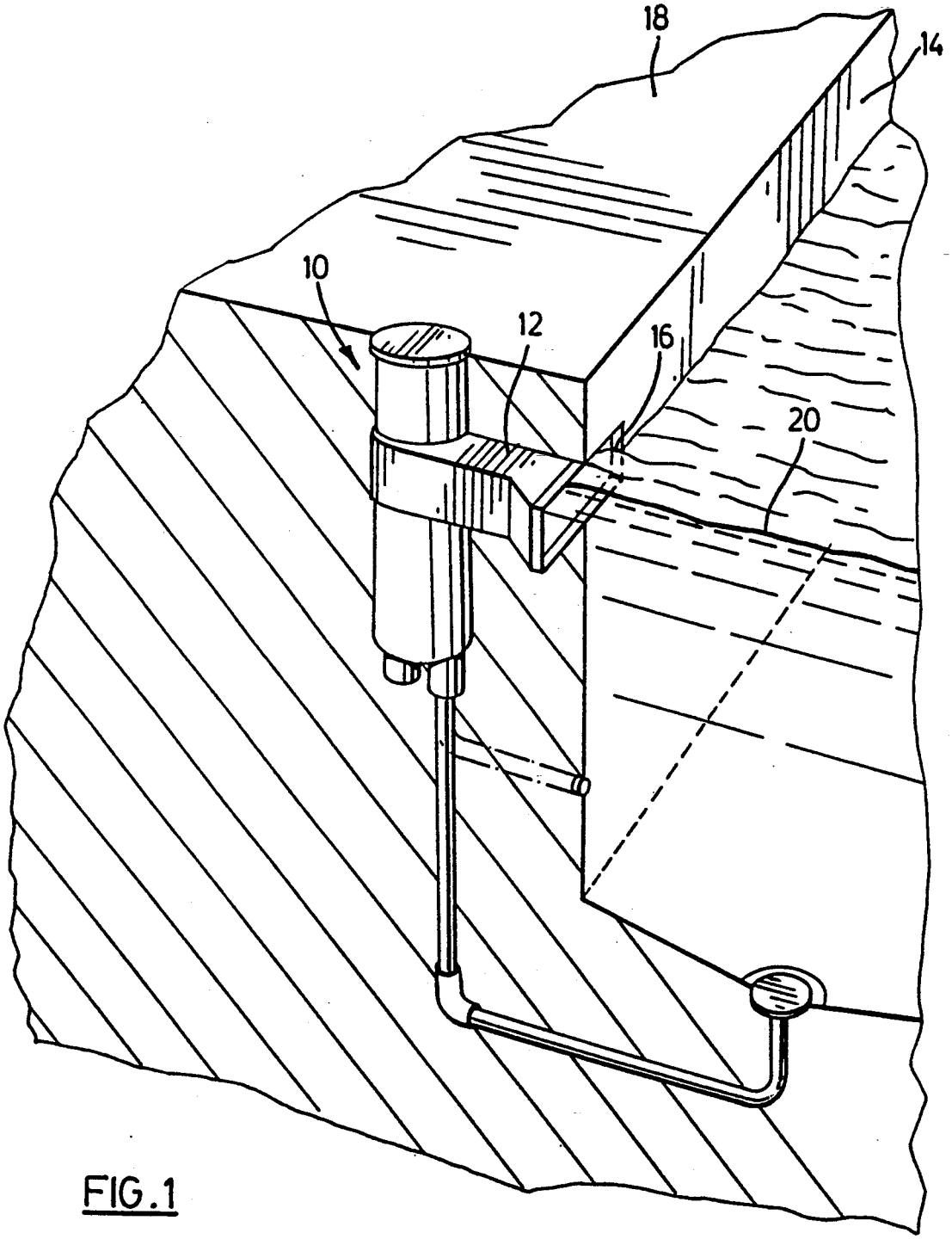
FIG. 1 is a diagrammatic view, partly broken away, illustrating a pool mounted water skimmer.

Referring first to FIG. 1, a typical arrangement of an installed water skimmer 10 is shown with a water skimmer housing 12 mounted on a pool wall 14 by a skimmer mount 16 located below a pool deck 18 and half submerged for the intake of surface water 20. The pool skimmer itself, other than mount 16, is not considered to be part of the present invention, so will not be described in further detail.

Figure 2:
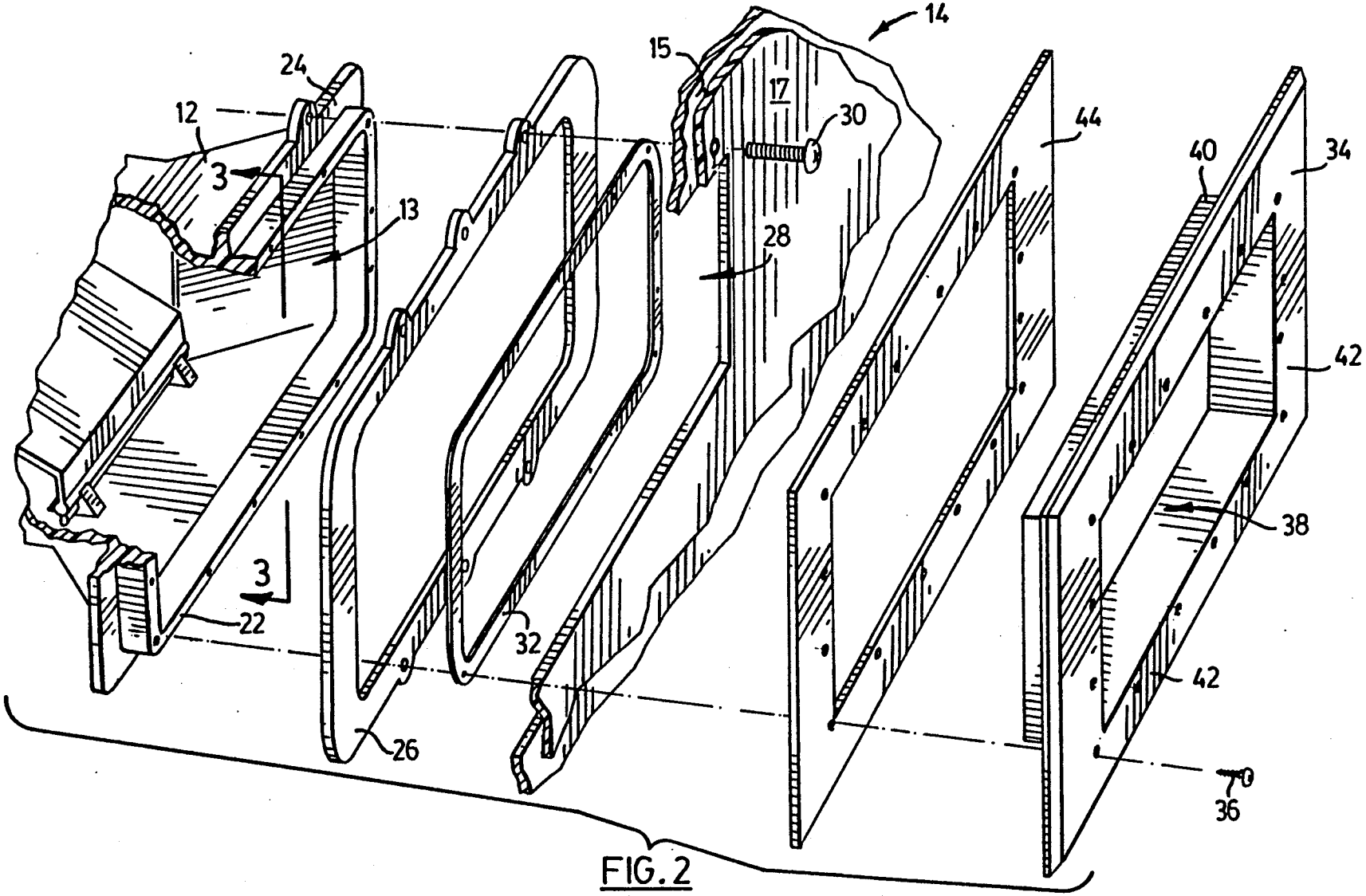
FIG. 2 is an exploded perspective view of a preferred embodiment of a water skimmer mount showing the water skimmer housing partly broken away.
Figure 3:
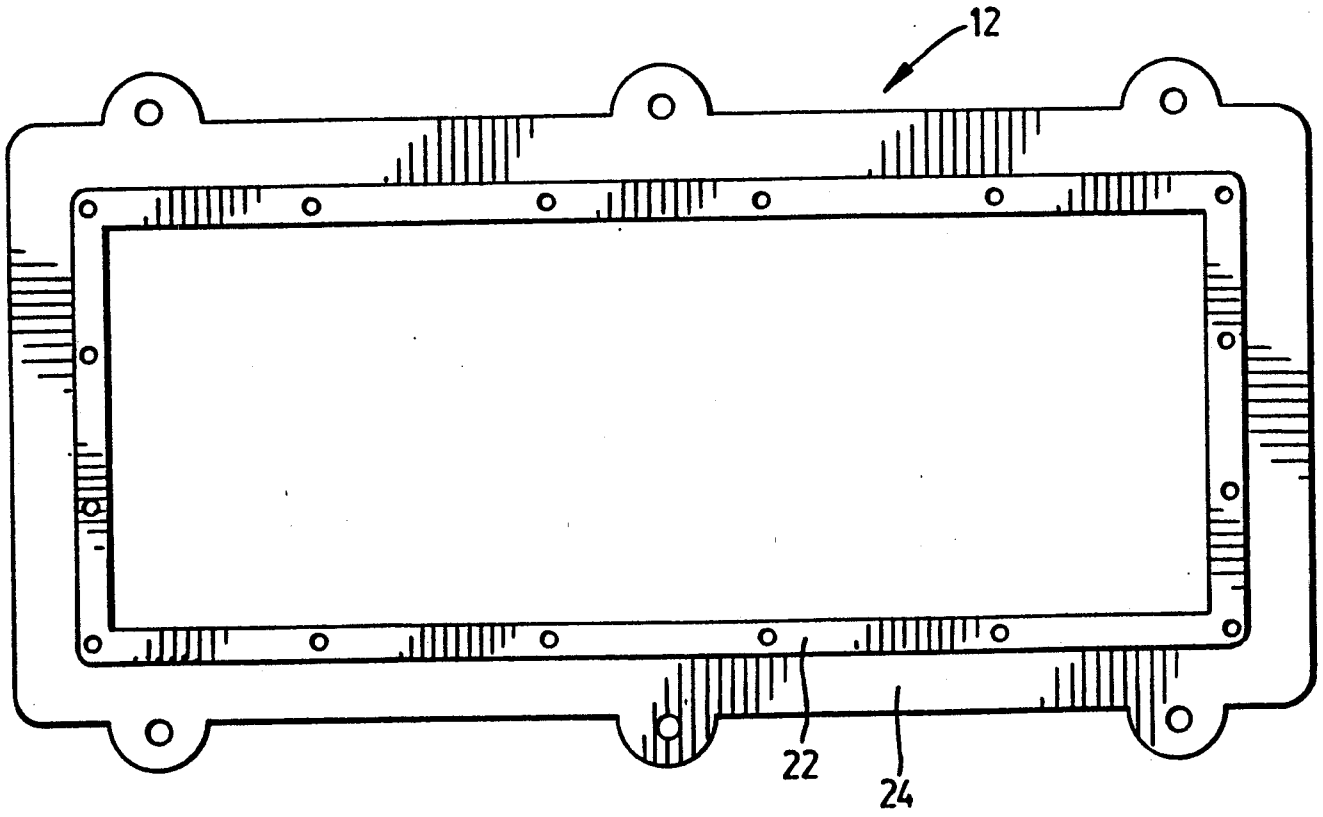
FIG. 3 is an elevational view taken along lines 3—3 of FIG. 2.

Referring now to FIGS. 2 and 3, the structure of a preferred embodiment of a water skimmer mount of the present invention will now be discussed. Housing 12 defines an inlet chamber 13 having a rectangular shape and includes a forwardly disposed chamber end portion 22. An outwardly projecting peripheral flange 24 is spaced rearwardly of chamber end portion 22. A rectangularly shaped inner gasket 26, fabricated of a soft, resiliently deformable material, fits over chamber end portion 22 and stops up against flange 24.

Pool wall 14 has a metal outer wall portion 15 and a flexible inner sheet liner 17 typically formed of vinyl. Metal wall portion 15 is typically formed of galvanized steel, but it could be made of any other metal, such as aluminum, or other materials as well. Wall 14 is provided with an opening or orifice 28 having a rectangular shape. Chamber end portion 22 has a rectangular cross section slightly smaller than that of orifice 28 to facilitate insertion of end portion 22 through orifice 28. A plurality of coupling bolts 30 secure housing 12 to the metal pool wall portion 15. A second gasket 32 butts up against chamber end portion 22 being of substantially the same inner and outer rectangular dimension as end portion 22. Gasket 32 is fabricated from a soft and resiliently deformable material.

A front annular face plate 34 is secured to chamber end portion 22 by screws 36. Face plate 34 is provided with a rectangular orifice 38 to permit communication between pool water 20 and water skimmer inlet chamber 13. Face plate 34 has a rearwardly projecting tubular lip 40 adapted to be slidingly located in housing inlet chamber 13. Lip 40 serves to permit easy alignment of face plate 34 onto chamber end portion 22. Face plate 34 includes an outer flange 42 which compresses pool liner 17 against gasket 32 and also acts as a covering for the heads of coupling bolts 30.

Figure 4:
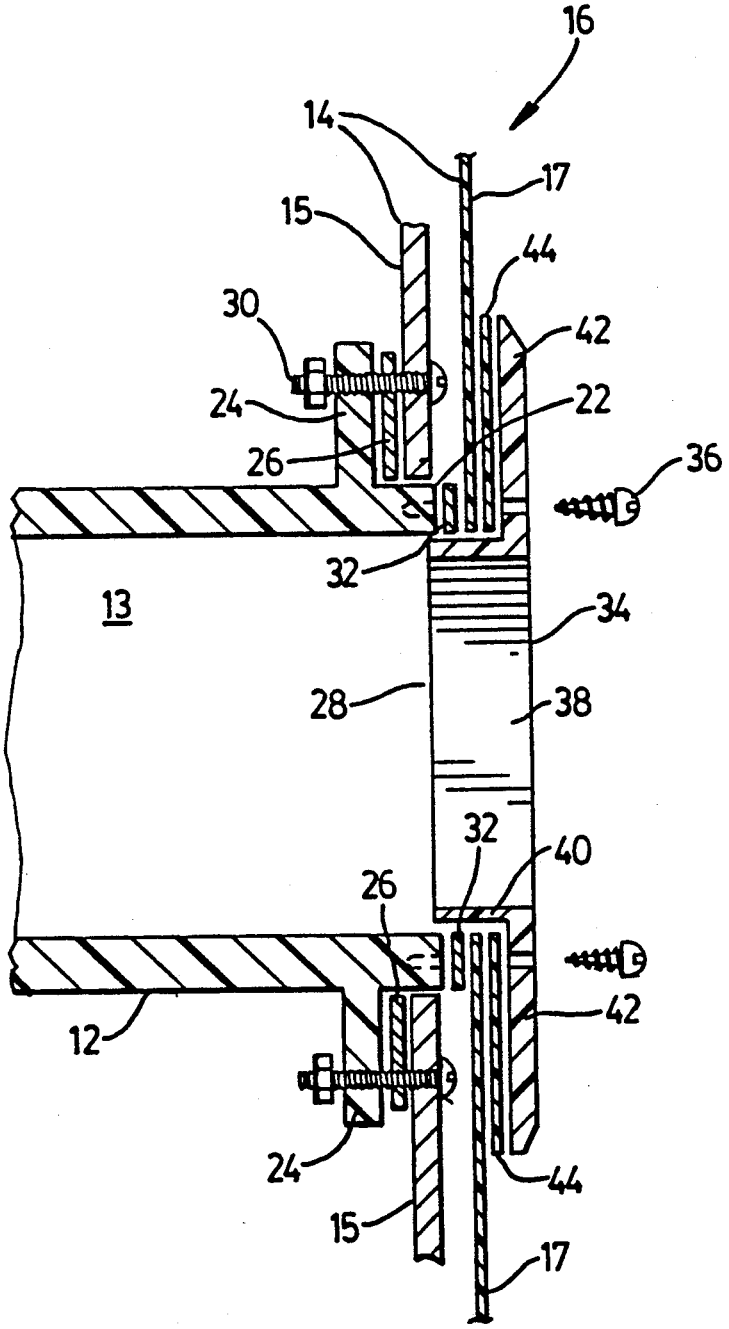
FIG. 4 is a sectional side view of the preferred embodiment of the water skimmer mount of the present invention.

Referring to FIG. 4, pool skimmer mount 16 is shown exploded and in vertical section to better illustrate the dual-gasket sealing action. The inlet chamber 13 of housing 12 projects through wall 14 with forwardly disposed chamber end portion 22 located just beyond or flush with the inner or water side of metal outer wall portion 15. Outer peripheral flange 24 is preferably integral with housing 12, being formed together at the time of moulding. The forward facing surface of flange 24 forms a receiving surface for gasket 26 which is compressed between flange 24 and the outer or land side of metal outer wall portion 15 when end portion 22 is inserted through wall 14. Pool wall portion 15 and flange 24 are coupled together by mounting bolts 30 equi-spaced along the upper and lower longitudinal sides of flange 24. This coupling joint effectively seals against ingress of dirt and other particulate matter into the space between the liner 17 and the metal wall 15.

The rearward displacement of flange 24 from end portion 22 is chosen so that when skimmer 10 is bolted to wall 15 end portion 22 protrudes forwardly slightly through wall 14 into the pool interior. Gasket 32 butts up against end portion 22 preferably being adhesively attached thereto to prevent it from sliding off end portion 22. Waterproof liner 17 fits over gasket 32 and cover the bolt heads associated with coupling bolts 30 protruding into the pool interior.

Face plate 34 is fastened directly to end portion 22 by screws 36 thereby compressing gasket 32 therebetween. Flange 42 also compresses liner 17 against the pool wall 15 thereby shielding the exposed bolt heads from the pool water. Face plate 34 includes a tubular lip 40 which provides a guiding and centering function when positioning face plate 34 on end portion 22 as well as acting as a retainer maintaining liner 17 in position. Where liner 17 is fabricated from vinyl and front flange 42 is made from ABS plastic, then plastic separator 44 is inserted between flange 42 and vinyl liner 17 to prevent mutual chemical degradation of each in the presence of the severe environment of chemically treated pool water. If this is not a problem, however, then separator 44 can be eliminated. It will be appreciated that separator 44 also acts as a gasket, and for this reason can be made from a suitable gasket material.

It will be appreciated that the dimensions of end portion 22 protruding through wall 14, gasket 32, face plate 34, waterproof liner 17 and plastic separator 44 are chosen to ensure that when face plate 34 is secured to end portion 22, liner 17 is pressed against pool wall 15 and gasket 32 is compressed sufficiently to form an effective seal. This prevents any exposed bare metal associated with either the bolt holes or the inner perimeter of orifice 28 from being contacted by pool water thereby greatly reducing the possibility of water induced corrosion of the former. It will also be appreciated that securing flange 24 to pool wall 15 and securing face plate 34 to inlet chamber end portion 22 compresses pool wall 14 between them which acts to laterally displace the stresses concentrated around bolts 30.

Figure 5:
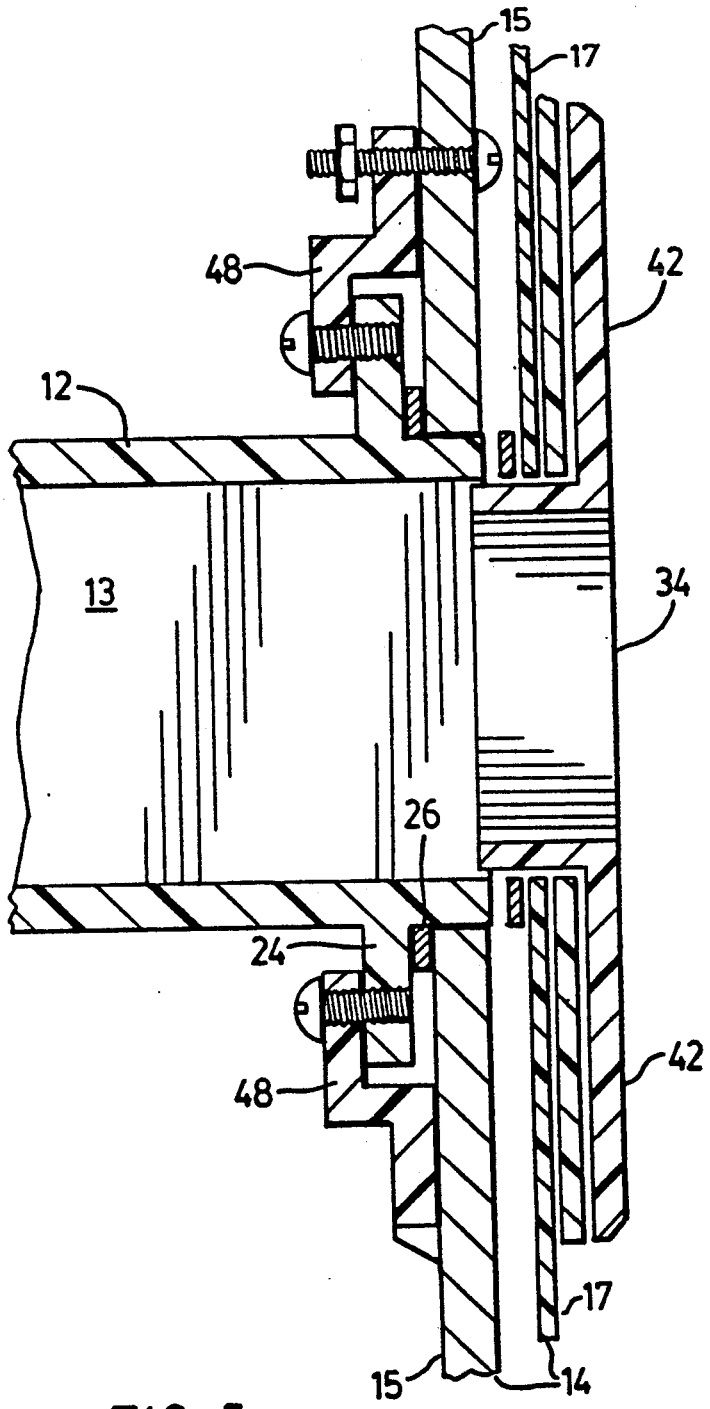
FIG. 5 is a sectional side view similar to FIG. 4 but showing an alternative embodiment of the water skimmer mount of the present invention.

FIG. 5 illustrates an alternative embodiment of the water skimmer mount of the present invention wherein the coupling scheme for mounting skimmer housing 12 onto metal pool wall portions 15 employs Z-shaped brackets 48 bolted or welded to pool wall 15. Brackets 48, where bolted, can be freely rotated when disengaged and can be fitted over and bolted to flange 24 for mounting housing 12 on wall 14.

Referring again to FIGS. 4 and 5, an alternative design for front face flange 42 would include having grooves recessed into the rear face of flange 42 adjacent to the pool wall interior. These grooves would form a receptacle for the bolt heads protruding into the pool interior.

While the present invention has been described and illustrated with respect to the preferred and alternative embodiments, it should be understood that numerous variations of these embodiments may be made without departing from the scope of the invention, which is defined in the appended claims.

What we claim is:

1. A pool skimmer mount for mounting a skimmer in an opening in a swimming pool wall having a metal outer wall portion and a flexible inner sheet liner; comprising: a housing having a forwardly disposed annular chamber end portion shaped to fit and project through the pool wall opening, the housing also having an outwardly projecting peripheral flange spaced from the chamber end portion, means for coupling the peripheral flange to the metal pool wall portion; a gasket located on the chamber end portion and behind the inner sheet liner; an annular face plate having an outer flange covering the chamber end portion; and means for attaching the face plate to the chamber end portion to compress the pool liner against the gasket.

2. A pool skimmer mount according to claim 1 and further comprising an inner gasket located between said peripheral flange and the metal pool wall portion.

3. A pool skimmer mount according to claim 1 and further comprising a separator located between the face plate outer flange and the pool liner.

4. A pool skimmer mount according to claim 2 wherein said peripheral flange is spaced from the chamber end portion a distance generally equal to the combined thickness of said inner gasket and the metal wall portion.

5. A pool skimmer mount according to claim 1 wherein the face plate has a tubular lip adapted to be slidingly located in the housing inlet chamber.

6. A pool skimmer mount according to claim 3, wherein the face plate has a tubular lip adapted to be slidingly located in the housing inlet chamber.

7. A pool skimmer mount for attaching a pool skimmer to a swimming pool wall having a metal outer wall portion and a flexible inner sheet liner, the mount comprising:

a housing located in an opening in said pool wall, the housing having an inlet chamber for communicating with pool surface water through said opening, the housing having a forwardly disposed chamber end portion projecting through the wall opening and an outwardly projecting peripheral flange spaced from the chamber end portion; means for connecting the peripheral flange to the metal pool wall portion; a continuous gasket mounted on the chamber end portion and located behind the inner sheet liner; an annular face plate having an outer, flange covering the chamber end portion; and means for attaching the face plate to the chamber end portions to compress the pool liner against the gasket.

8. A pool skimmer mount as claimed in claim 7 wherein the connecting means are a plurality of threaded fasteners spaced apart around the peripheral flange.

9. A pool skimmer mount as claimed in claim 7 wherein the connecting means are a plurality of Z-shaped clamping brackets attached to the metal pool wall portion in engagement with the peripheral flange.

10. A pool skimmer mount as claimed in claim 7 and further comprising a second continuous gasket located between said peripheral flange and the metal pool wall portion.

11. A pool skimmer mount as claimed in claim 7 and further comprising a separator located between the face plate outer flange and the pool liner.

12. A pool skimmer mount as claimed in claim 7 wherein the face plate has a tubular lip adapted to be slidingly located in the housing inlet chamber.

13. A pool skimmer mount as claimed in claim 8 wherein the face plate has a tubular lip adapted to be slidingly located in the housing inlet chamber.

14. A pool skimmer mount as claimed in claim 7 wherein said peripheral flange is spaced from the chamber end portion a distance generally equal to the combined thickness of said inner gasket and the metal wall portion.

15. A pool skimmer mount as claimed in claim 8 wherein said peripheral flange is spaced from the chamber end portion a distance generally equal to the combined thickness of said inner gasket and the metal wall portion.

* * * * *